US011114223B1

(12) United States Patent
Krotosky et al.

(10) Patent No.: US 11,114,223 B1
(45) Date of Patent: Sep. 7, 2021

(54) THREE-DIMENSIONAL THERMISTOR PLATFORM AND A METHOD FOR MANUFACTURING THE SAME

(71) Applicant: Tronics MEMS, Inc., Addison, TX (US)

(72) Inventors: Jeffrey Krotosky, Lewisville, TX (US); Zhihua Cai, Plano, TX (US)

(73) Assignee: Tronics MEMS, Inc., Addison, TX (US)

( * ) Notice: Subject to any disclaimer, the term of this patent is extended or adjusted under 35 U.S.C. 154(b) by 0 days.

(21) Appl. No.: 16/940,050

(22) Filed: Jul. 27, 2020

(51) Int. Cl.
*H01C 7/00* (2006.01)
*H01C 17/06* (2006.01)
*H01C 1/14* (2006.01)

(52) U.S. Cl.
CPC ..... *H01C 7/008* (2013.01); *H01C 1/14* (2013.01); *H01C 17/06* (2013.01)

(58) Field of Classification Search
CPC ..... H01C 7/008; H01C 1/14; H01C 17/06
See application file for complete search history.

(56) References Cited

U.S. PATENT DOCUMENTS 4,901,051 A * 2/1990 Murata ..... G01K 7/18 29/612
5,332,991 A * 7/1994 Kojima ..... G01K 7/183 338/25
5,406,246 A * 4/1995 Friese ..... G01K 7/18 338/22 R
6,140,906 A * 10/2000 Kaihara ..... G01K 7/183 29/610.1
8,333,506 B2 * 12/2012 Kamenov ..... G01K 7/223 374/185
10,495,521 B2 * 12/2019 Matsumoto ..... G01N 27/403
2016/0358849 A1 * 12/2016 Jur ..... H01L 35/28

* cited by examiner

*Primary Examiner* — Kyung S Lee

(57) ABSTRACT

A three-dimensional thermistor device and a manufacturing method thereof. The three-dimensional thermistor device comprising a thermistor array formed on a base layer extending in first and second directions. Where the thermistor array comprises: thermistor pattern layers and insulating layers stacked alternately on the base layer in a third direction; each thermistor pattern layer including a continuous electrically conductive first trace disposed along a first path extending in both the first and second directions, and each insulating layer including an electrically conductive first via extending through the insulating layer in the third direction to electrically connect the first traces to each other. Where successive electrical connections between the respective first vias on the stacked insulating layers and the respective first traces on the stacked thermistor layers form a continuous electrical first thermistor element extending in the first, second and third directions across multiple of the thermistor pattern layers.

19 Claims, 7 Drawing Sheets

THREE-DIMENSIONAL THERMISTOR PLATFORM AND A METHOD FOR MANUFACTURING THE SAME

TECHNICAL FIELD

The disclosure relates to a thermistor structured in three-dimensions, and a manufacturing method thereof. In one embodiment, a foil type thermistor having a three-dimensional thermistor path is described.

BACKGROUND

Foil type thermistors are used in many different applications for temperature sensing. Currently, foil type thermistors are structured in lateral directions, such that the thermistor paths have a flat structure. Currently, the footprint size of foil type thermistors is limited by lithography and printing technology. The inability to scale the footprint of the thermistor is a drawback for small spot temperature sensing when mounting surface area is at a premium, as thermistors are traditionally only scaled in lateral directions. Conventionally, to maintain a certain sensitivity of the thermistor, the thermistor must maintain a certain footprint. Thus, traditionally, a thermistor's sensitivity would be compromised in order to attain a smaller footprint.

Mounting a thermistor on a curved or irregular surface can be problematic if the structure of the thermistor is rigid. Conventionally, a custom package or mounting for the thermistor is necessary for mounting on a curved or irregular surface.

SUMMARY

To solve the above-mentioned problems, it is an aspect of the current invention to provide a foil type thermistor scalable in three dimensions. By scaling the thermistor in three dimension, a footprint of the thermistor maybe be reduced while still achieving a desired sensitivity level of the thermistor.

It is an aspect of this disclosure to provide a three-dimensional thermistor device comprising: a thermistor array formed on a base layer extending in first and second directions; wherein the thermistor array comprises: thermistor pattern layers and insulating layers stacked alternately on the base layer in a third direction; each thermistor pattern layer including a continuous electrically conductive first trace disposed along a first path extending in both the first and second directions, each first trace having a respective first terminal point and a respective second terminal point spaced-apart along the first path and an effective length measured along the first path between the first and second terminal points; and each insulating layer including an electrically conductive first via extending through the insulating layer in the third direction; wherein the respective first terminal point of each thermistor pattern layer is electrically connected to the respective first via of one adjacent-stacked insulating layer and the respective second terminal point of that thermistor pattern layer is electrically connected to the respective first via of the other adjacent-stacked insulating layer, and wherein successive electrical connections between the respective first vias on the stacked insulating layers and the respective first traces on the stacked thermistor layers form a continuous electrical first thermistor element extending in the first, second and third directions across multiple of the thermistor pattern layers and having a first thermistor element length, the first thermistor element length being greater than or equal to a sum of the respective effective lengths of the respective first traces on the thermistor pattern layers.

It is an aspect of this disclosure to provide a three-dimensional thermistor device, wherein the first traces are formed of a metal or metal alloy.

It is an aspect of this disclosure to provide a three-dimensional thermistor device, wherein the first traces are foils of metal or metal alloy.

It is an aspect of this disclosure to provide a three-dimensional thermistor device, wherein the metal foils are laminates formed of two different metals or metal alloys.

It is an aspect of this disclosure to provide a three-dimensional thermistor device, wherein the insulating layer is formed of a flexible polyimide material.

It is an aspect of this disclosure to provide a three-dimensional thermistor device, further comprising: each thermistor pattern layer including a continuous electrically conductive second trace disposed along a second path extending in both the first and second directions, each second trace having a respective third terminal point and a respective fourth terminal point spaced-apart along the second path and an effective length measured along the second path between the third and fourth terminal points; each insulating layer including an electrically conductive second via extending through the insulating layer in the third direction; wherein the respective third terminal point of each thermistor pattern layer is electrically connected to the respective second via of one adjacent-stacked insulating layer and the respective fourth terminal point of that thermistor pattern layer is electrically connected to the respective second via of the other adjacent-stacked insulating layer, and wherein successive electrical connections between the respective second vias on the stacked insulating layers and the respective second traces on the stacked thermistor layers form a continuous electrical second thermistor element extending in the first, second and third directions across multiple of the thermistor pattern layers and having a second thermistor element length, the second thermistor element length being greater than or equal to a sum of the respective effective lengths of the respective second traces on the thermistor pattern layers; and the base layer including a continuous electrically conductive third trace disposed along a third path extending in both the first and second directions, the third trace having a fifth terminal point and a sixth terminal point spaced-apart along the third path; and wherein the fifth terminal point of the base layer is electrically connected to the first thermistor element and the sixth terminal point of the base layer is electrically connected to the second thermistor element to form a combined thermistor element extending in the first, second and third directions across multiple of the thermistor pattern layers, the combined thermistor element having an overall thermistor length greater than or equal to a sum of the first thermistor element length and the second thermistor element length.

It is an aspect of this disclosure to provide a three-dimensional thermistor device, wherein each electrical end of the combined thermistor element is connected to a device terminal, and the device terminals are accessible from a single side of the thermistor device.

It is an aspect of this disclosure to provide a three-dimensional thermistor device, wherein the first traces and second traces have a serpentine-type structure along the first and second directions.

It is an aspect of this disclosure to provide a three-dimensional thermistor device electrically connectable with an electrical circuit, the three-dimensional thermistor device comprising: a plurality of terminals including a first terminal and a second terminal, the first and second terminals configured to electrically connect the three-dimensional thermistor device to the electrical circuit; a plurality of traces, the plurality of traces disposed along a stacking axis, the plurality of traces comprising: a first trace disposed at a first end of the three-dimensional thermistor device along the stacking axis, and a last trace disposed at a second end of the three-dimensional thermistor device opposite of the first end along the stacking axis, at least one intermediate trace disposed along the stacking axis between the first trace and last trace; wherein each of the plurality of traces comprises at least one via configured to electrically connect the respective trace to an adjacent trace of the plurality of traces; and a plurality of flexible insulating layers disposed along the stacking axis, the plurality of flexible insulating layers comprising: a first flexible insulating layer disposed along the stacking axis adjacent to an outside surface of the first trace, a last flexible insulating layer disposed along the stacking axis adjacent to an outside surface of the last trace, and at least one intermediate flexible insulating layer disposed along the stacking axis between the first flexible insulating layer and the last flexible insulating layer, wherein the plurality of traces are interleaved with the plurality of flexible insulating layers along the stacking axis such that each of the plurality of traces is disposed between and adjacent to two of the plurality of flexible insulating layers.

It is an aspect of this disclosure to provide a three-dimensional thermistor device, wherein each of the plurality of traces is formed of a metal or metal alloy.

It is an aspect of this disclosure to provide a three-dimensional thermistor device, wherein each of the plurality of traces is a laminate formed of two different metals or metal alloys.

It is an aspect of this disclosure to provide a three-dimensional thermistor device, wherein the laminate comprises: a first layer of platinum; a layer of gold overlying the first layer of platinum; and a second layer of platinum overlying the layer of gold.

It is an aspect of this disclosure to provide a three-dimensional thermistor device, wherein each of the plurality of flexible insulating layers is formed of a flexible polyimide material.

It is an aspect of this disclosure to provide a three-dimensional thermistor device, wherein: each of the first trace and the at least one intermediate trace comprise a first trace portion and a second trace portion, the at least one via of each of the plurality of traces includes a first via and a second via, each of the plurality of the first trace portions is electrically connected to an adjacent first trace portion by the first via of the respective trace such that each of first trace portions are electrically connected to each other to form a first electrically connected portion, each of the plurality of the second trace portions is electrically connected to an adjacent second trace portion by the second via of the respective trace such that the plurality of second trace portions are electrically connected to each other to form a second electrically connected portion, and the first via of the last trace contacts the first electrically connected portion and the second via of the last traces contacts the second electrically connection portion such that the last trace electrically connects the first electrically connected portion to the second electrically connected portion to form a combined electrically connected portion, the combined electrically connected portion having an overall length greater than or equal to a sum of a length of the first electrically connected portion and a length of the second electrically connected portion.

It is an aspect of this disclosure to provide a three-dimensional thermistor device, wherein: the first trace portion of the first trace includes the first terminal, the second trace portion of the first trace includes the second terminal, the first terminal and second terminal are disposed on a single side of the three-dimensional thermistor device.

It is an aspect of this disclosure to provide a three-dimensional thermistor device, wherein each of the plurality of traces has a serpentine-type structure along a plane perpendicular to the stacking axis.

It is an aspect of this disclosure to provide a method for manufacturing a three-dimensional thermistor device, the method comprising: forming a first flexible insulating layer; depositing a first trace layer on a top surface of the first flexible insulating layer; depositing a second flexible insulating layer on a top surface of the first trace layer, the second flexible insulating layer comprising at least one through-hole through which the first trace layer is exposed; depositing a second trace layer on a top surface of the second flexible insulating layer, the second trace layer including at least one via formed in the at least one through-hole of the second flexible insulating layer that contacts the first trace layer to electrically connect the first trace layer and the second trace layer; and depositing a third flexible insulating layer on a top surface of the second trace layer, the third flexible insulating layer comprising a through-hole through which the second trace layer is exposed.

It is an aspect of this disclosure to provide a method for manufacturing a three-dimensional thermistor device, wherein the depositing of at least one of the first trace layer and the second trace layer comprises depositing the trace layer as a laminate formed of two different metals or metal alloys.

It is an aspect of this disclosure to provide a method for manufacturing a three-dimensional thermistor device, wherein: the second trace layer comprises a first trace portion and a second trace portion, the at least one through-hole of the second flexible insulating layer comprises a first through-hole and a second through-hole, the at least one via comprises a first via formed in the first through-hole and electrically connected to the first trace portion and a second via formed in the second through-hole and electrically connected to the second trace portion, and the first trace layer is electrically connected to the first via and the second via.

It is an aspect of this disclosure to provide a method for manufacturing a three-dimensional thermistor device, wherein: the first trace layer is deposited on the top of the first flexible insulating layer to have a serpentine-type structure, and the second trace layer is deposited on the top of the second flexible insulating layer to have a serpentine-type structure.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1A:
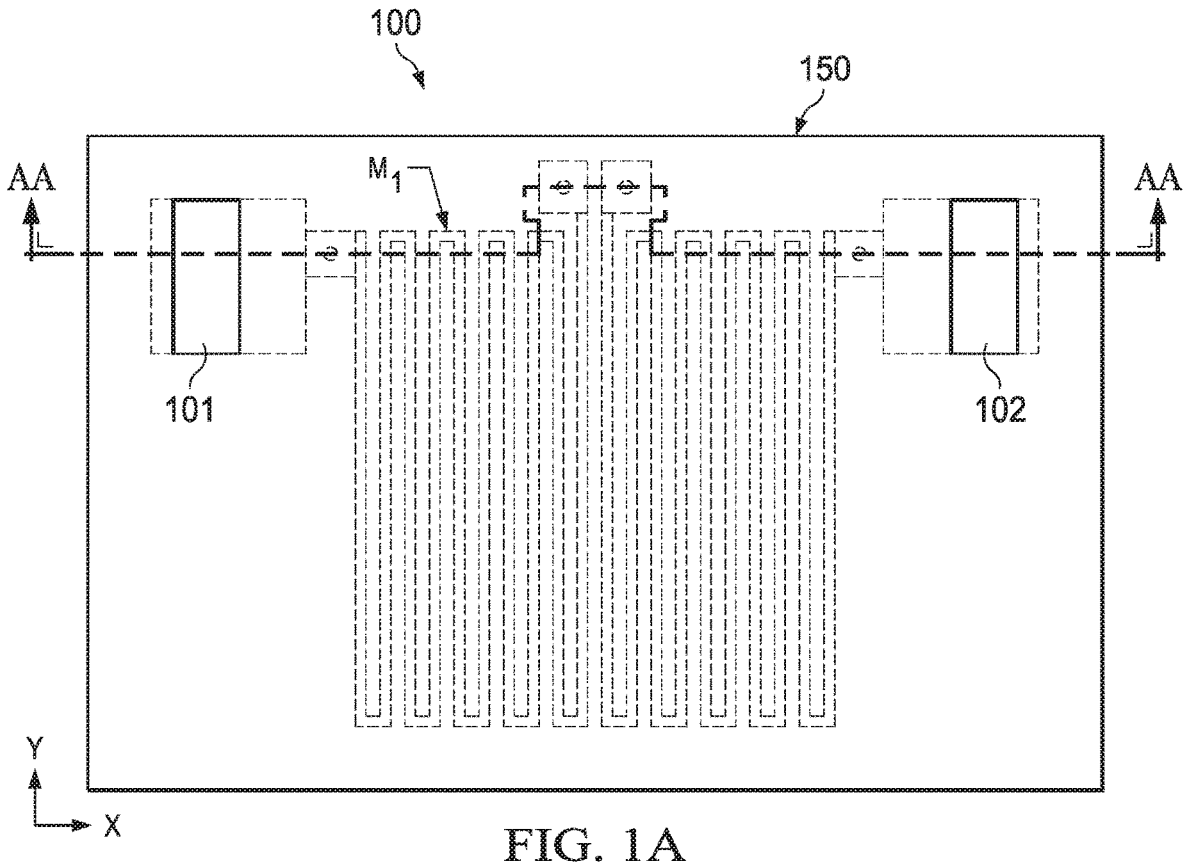
FIG. 1A illustrates a top view of a thermistor in accordance with an embodiment of the disclosure.
Figure 1B:
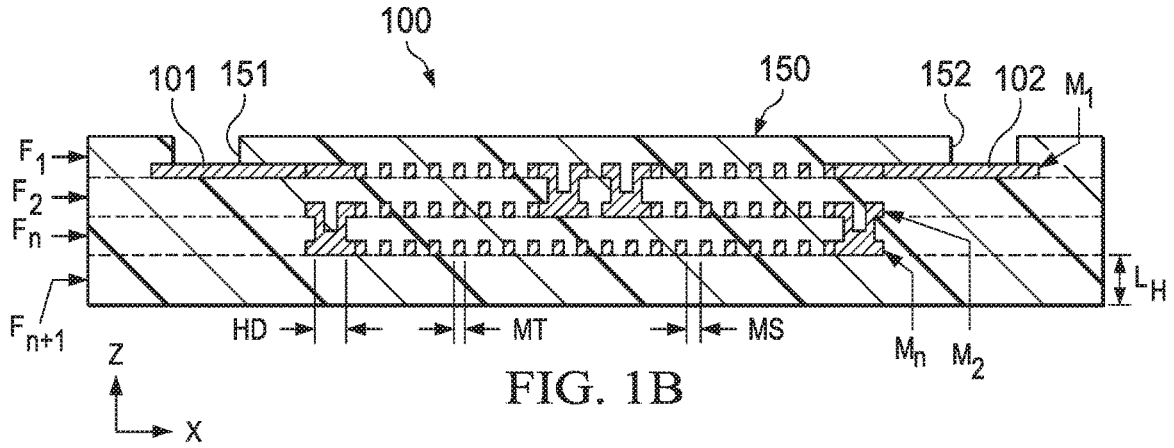
FIG. 1B illustrates a cross-sectional side view of the thermistor of FIG. 1A taken along line AA of FIG. 1A.
Figure 2:
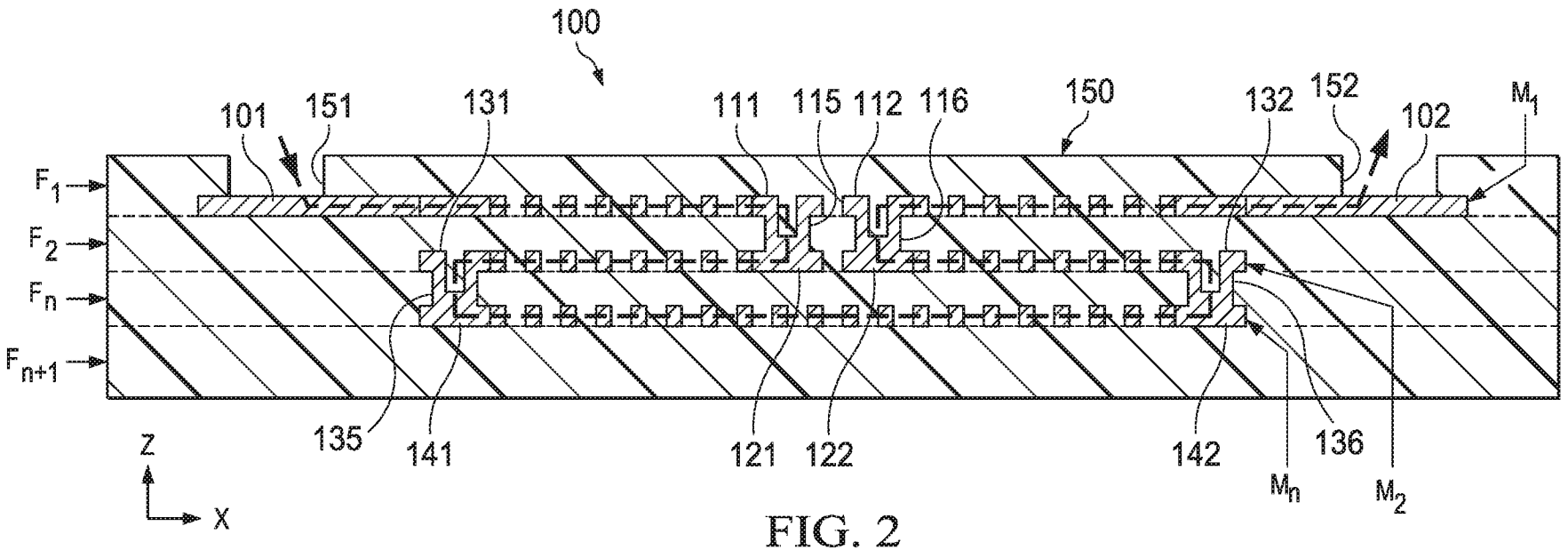
FIG. 2 illustrates a cross-sectional side view of the thermistor FIG. 1A taken along line AA of FIG. 1A and further illustrates a signal path through the thermistor.

FIG. 1A illustrates a top view of a thermistor 100 in accordance with an embodiment of the disclosure. FIG. 1B illustrates a cross-sectional side view taken along line AA of FIG. 1A. FIG. 2 illustrates a cross-sectional side view taken along line AA of FIG. 1A and illustrates a signal path through the thermistor;

Referring to FIGS. 1A, 1B, and 2, a thermistor 100 can be scalable in the X-, Y- and Z-directions. By being structured to extend in the Z-direction, thermistor 100 can have a reduced surface area in a plane corresponding to the X-axis and Y-axis. Thus, thermistor 100 can have a reduced footprint in the X-axis and Y-axis and still maintain a sufficiently long thermistor path length to provide a desired sensitivity due to scaled metal foils layered along the Z-axis. The reduced footprint of thermistor 100 allows for improved temperature sensing for small spot temperature sensing applications or where surface area available for placement of the thermistor device is limited.

The thermistor 100 can comprise a plurality of terminals. Thermistor 100 comprises two terminals 101, 102 which can be used to connect thermistor 100 to an electrical circuit. One skilled in the art will recognize that a thermistor does not have a polarity. Thus, the thermistor 100 may operate properly with either terminal 101 or 102 being connected to a power source of the electrical circuit. One having ordinary skill in the art will understand that thermistor 100 can have 3 or 4 terminals to make the thermistor a three wire or four wire sensor to improve the accuracy of thermistor 100. Terminals 101, 102 can be electrically connected to the electrical circuit using soldering or other known methods. The thermistor device can be physically mounted to a desired substrate using different methods including glue, adhesive, or a biocompatible adhesive.

For purposes of explanation for this disclosure, terminal 101 will be described as being connected to a power source. Thus, terminal 102 will be described as return side terminal. Terminal 101 can also be referred to as an input signal terminal and terminal 102 can also be referred to as an output signal terminal. Again, these descriptions are only being made for consistency reasons in the description of thermistor 100, as either terminal 101 or 102 can be connected to the power source.

In one embodiment, terminal 101 can be connected to a power source to supply the thermistor 100 with an electrical current and voltage. Terminal 102 can be a return terminal of the thermistor. The thermistor 100 can provide a resistance such that the electrical current and voltage measured at terminal 102 is less than the current and voltage supplied to the thermistor 100 at terminal 101.

One skilled in the art will understand the relationship between voltage, current, and resistance. Ohm's law states that V=IR, where V represents a voltage, I represents an electrical current, and R represents a resistance. Voltage and electrical current are linearly related. One skilled in the art will recognize that a thermistor limits both voltage and current across the thermistor. Thus, a thermistor is not limited to applications of resisting current, but may also be used for application in which a reduction in voltage is desired. Thus, while this application largely refers to the thermistor 100 as resisting a flow of current, one skilled in the art will understand that the electrical resistance provided by the thermistor will also cause the voltage to drop across the thermistor.

In foil type thermistors, the opposition to current flow is provided by a thin piece of metal, referred to as the foil. The thermistor 100 can be provided with a metal foil layer $M_1$. The foil layer $M_1$ is provided to conduct and resist the current passing from terminal 101 to terminal 102. The foil layer $M_1$ can extend from terminal 101 along the Y-axis for a certain length. The foil layer $M_1$ can comprise a bent portions comprising two 90-degree bends such that the foil layer extends in back and forth along the y-direction between the terminals of metal layer $M_1$ such that the foil layer $M_1$ has a zigzag or serpentine type structure, as illustrated in FIG. 1A.

In other embodiments, the metal foil of the thermistor can be replaced by continuous lines, or traces, of electrically conductive material, including metals, conductive plastic, conductive inks or other conductive materials. The three-dimensional structures described for foil-type thermistors can be readily adapted to use traces of such conductive material rather than foil.

As illustrated in FIG. 1B, the thermistor 100 can have a plurality of foil layers also known as pattern layers that are stacked along a stacking axis. As illustrated in FIG. 1B, the thermistor 100 can have a number of foil layers ranging from $M_1$ to $M_n$. Each metal layer $M_1$ to $M_n$ can have a serpentine type structure (referring to FIGS. 1A, 3A, 5A, and 7A) similar to the structure of metal layer $M_1$, described above.

FIG. 2 illustrates a flow of signal traveling through the thermistor 100. In FIG. 2, the flow of the signal is represented with dashed arrow lines. In FIG. 2, an input signal is supplied to terminal 101. The foil layers (or pattern layers) $M_1$-$M_n$ are electrically connected by vias 115, 116, 135 and 136. As illustrated by FIG. 2, the input signal travels from terminal 101 along a first metal portion of metal layer $M_1$ toward terminal 111. Terminal 111 is electrically connected to and end of via 115. Another end of via 115 is electrically connected to terminal 121 of a first portion of metal foil layer $M_2$. The signal travels from terminal 111 through via 115 to terminal 121 at which point the signal travels along the first portion of metal layer $M_2$ to terminal 131. The signal continues to flow through the metal layers and vias of thermistor 100 as shown in FIG. 2. The signal travels from terminal 131 through via 135 to terminal 141 of metal layer $M_n$. The signal then flows through metal layer $M_n$ to terminal 142. At terminal 142, the signal travels through via 136 to terminal 132 of a second portion of metal layer $M_2$. From terminal 132 the signal travels to terminal 122. At terminal 122, the signal travels through via 116 to terminal 112 of a second portion of metal layer $M_1$. From terminal 112, the signal then travels to output terminal 102.

The signal supplied to the thermistor 100 at terminal 101 travels through the plurality of foil layers $M_1$-$M_n$ to terminal 102 as described above. One having ordinary skill in the art will understand how a signal traveling between metal foil layers with vias as described can be performed with any number of metal foil layers $M_n$. In preferred embodiments, thermistor 100 can have between two and five metal foil layer $M_n$. As previously described, in other embodiments, traces of conductive material may be used instead of foil to produce thermistor pattern layers $M_1$-$M_n$.

Referring to FIG. 1B, the plurality of foil layers $M_1$-$M_n$ can be encompassed by a body or housing 150 formed of an electrically insulating material. In some embodiments, the electrically insulating material of the body 150 can be a flexible material, whereas in other embodiments, the electrically insulating material can be a rigid material. The electrically insulating material of housing 150 can be thermally conductive to conduct heat from a surrounding of the thermistor to the foil layers $M_1$-$M_n$. The body or housing 150 can comprise a plurality of electrically insulating layers $F_1$-$F_{n+1}$, (also referred to as flexible layers $F_1$-$F_{n+1}$ when the electrically insulating material is flexible), which can be stacked along the stacking axis and interleaved with the foil layers (pattern layers) $M_1$-$M_n$. For purposes of compact description, the embodiments having flexible layers $F_1$-$F_{n+1}$ are described in detail, whereas the embodiments having rigid insulating layers are understood to be substantially identical (i.e., except for the flexibility of the insulating material) unless otherwise indicated. Since the flexible material layers surrounds the plurality of foil layers, there can be one more flexible layer than there are metal foil layers. Accordingly, in some embodiments there can be $M_n$ number of foil layers and $F_{n+1}$ number of flexible layers.

The flexible layer $F_1$ is the topmost layer with respect to the Z axis of the flexible material housing 150. Layer $F_1$ can be provided with holes 151 and 152 to allow for access to terminals 101 and 102. Hole 151 is positioned on flexible layer $F_1$ such that terminal 101 is accessible for connection from an outside of thermistor 100. Hole 152 is positioned on $F_1$ such that terminal 102 is accessible for connection from an outside of thermistor 100.

The flexible material layers (insulating layers) are provided between the plurality of metal foil layers or thermistor pattern layers. As shown in FIG. 1B, flexible layer $F_2$ is disposed between foil layer $M_1$ and foil layer $M_2$. Layer $F_2$ can be provided with a hole $H_{2a}$ (referring to FIG. 6B) through which via 115 can pass. Layer $F_2$ can be provided with another hole $H_{2b}$ (referring to FIG. 6B) in which via 116 can pass. Each of the plurality of flexible layers $F_2$-$F_n$ provided between foil layers $M_1$-$M_n$ can be have similar holes $H_{na}$, $H_{nb}$ to allow for vias to pass through the holes so that a signal can pass between the plurality of foil layers $M_1$-$M_n$.

Flexible material layer $F_{n+1}$ can be provided as the bottom layer among the plurality of flexible layers of flexible material housing 150. Flexible material layer $F_{n+1}$ can be provided without any holes.

The flexible material housing 150 and flexible layers $F_1$-$F_{n+1}$ (insulating layers) thereof can be made of a polymer type material. In a preferred embodiment, the flexible layers $F_1$-$F_{n+1}$ are made of a polyimide material. In other embodiments, the flexible layers $F_1$-$F_{n+1}$ can be made of other epoxy-based negative resists, liquid crystal polymers, polymeric organosilicon compounds, thermoplastics, or other polymer type materials. In an embodiment, the flexible material housing 150 and flexible layer $F_1$-$F_{n+1}$ thereof can be made of a material with a dielectric constant between 2 and 5 at 1 kHz. In an embodiment, the flexible material housing 150 and flexible layers $F_1$-$F_{n+1}$ thereof can be made of a material with a glass transition temperature greater than 150 degrees Celsius. In an embodiment, the flexible material housing 150 and flexible layers $F_1$-$F_{n+1}$ thereof can be made of a material with a Young's modulus of less than 10 GPa.

The flexible layers $F_1$-$F_{n+1}$ (insulating layers) have desirable heat transfer properties so as to efficiently transfer heat from a surrounding to the flexible metal layers $M_1$-$M_n$. The flexible layers $F_1$-$F_{n+1}$ have desirable flexibility properties so that the thermistor 100 can conform to potential surfaces of which it measures the temperature.

Referring to FIG. 1B, the flexible material layer $F_{n+1}$ has a layer height LH in the Z-direction (i.e., along the stacking axis). In a preferred embodiment, the LH of each of the flexible material layers $F_1$-$F_{n+1}$ is 15 μm. The conductive traces of the metal foil layers $M_n$ have a metal thickness MT in the X direction (i.e., perpendicular to the stacking direction). In a preferred embodiment, the MT of each trace of the metal foil layers $M_1$-$M_n$ is 10 μm. The metal foil layers $M_n$ have a spacing between the traces of the foils MS in the X-direction. In a preferred embodiment, the MS is 10 μm. As previously described, flexible layers $F_2$-$F_n$ have holes through which vias electrically connect the traces of the foil layers $M_1$-$M_n$. In a preferred embodiment the holes of layers $F_2$-$F_n$ through which vias pass have a hole diameter HD of 70 μm. As described above, flexible material layer $F_1$ can have holes 151, 152 by which the terminals 101, 102 can be contacted. In a preferred embodiment, the hole diameters HD of holes 151, 152 is 300 μm.

In an embodiment, spin coating can be used to sequentially form the polymer flexible layers $F_1$-$F_{n+1}$. Spin coating can be used to spin the polymer-based material (in the preferred embodiment, a polyimide) onto a substrate material and then curing of the spin coated film can be performed to solidify the polymer-based material to form each flexible layer $F_1$-$F_{n+1}$. In another embodiment, each of the flexible layers $F_1$-$F_{n+1}$ can be formed by a process of Chemical Vapor Deposition ("CVD"). A flexible material for housing 150 is desirable so that thermistor 100 can conform to the shape of an adjacent surface. Additionally, the flexible material allows for a plurality of thermistors 100 to be made in a single flexible sheet, where the thermistors 100 can be individually laser cut or diced from the sheet.

In a preferred embodiment, each metal layer $M_n$ can be formed by processes of electron beam evaporation or sputtering. In other embodiments, each metal layer $M_n$ can be formed by processes of CVD deposition, atomic layer deposition, or electroplating.

The thermistor 100 can be manufactured in a way such that flexible and metal layers are sequentially formed on one another. For example, the bottom flexible layer $F_{n+1}$ can be formed according to the methods previously described. Next metal layer $M_n$ can be formed using the methods previously described onto a top of the flexible layer $F_{n+1}$. Next, flexible layer $F_n$ can be formed onto a top of metal layer $M_n$ and flexible layer $F_{n+1}$ according to the methods described above. This process can be continued until a desired number of flexible layers and metal layers for the thermistor 100 is achieved.

Referring to FIGS. 3A-7B, a method of manufacturing thermistor 100 will be described.

Figure 3A:
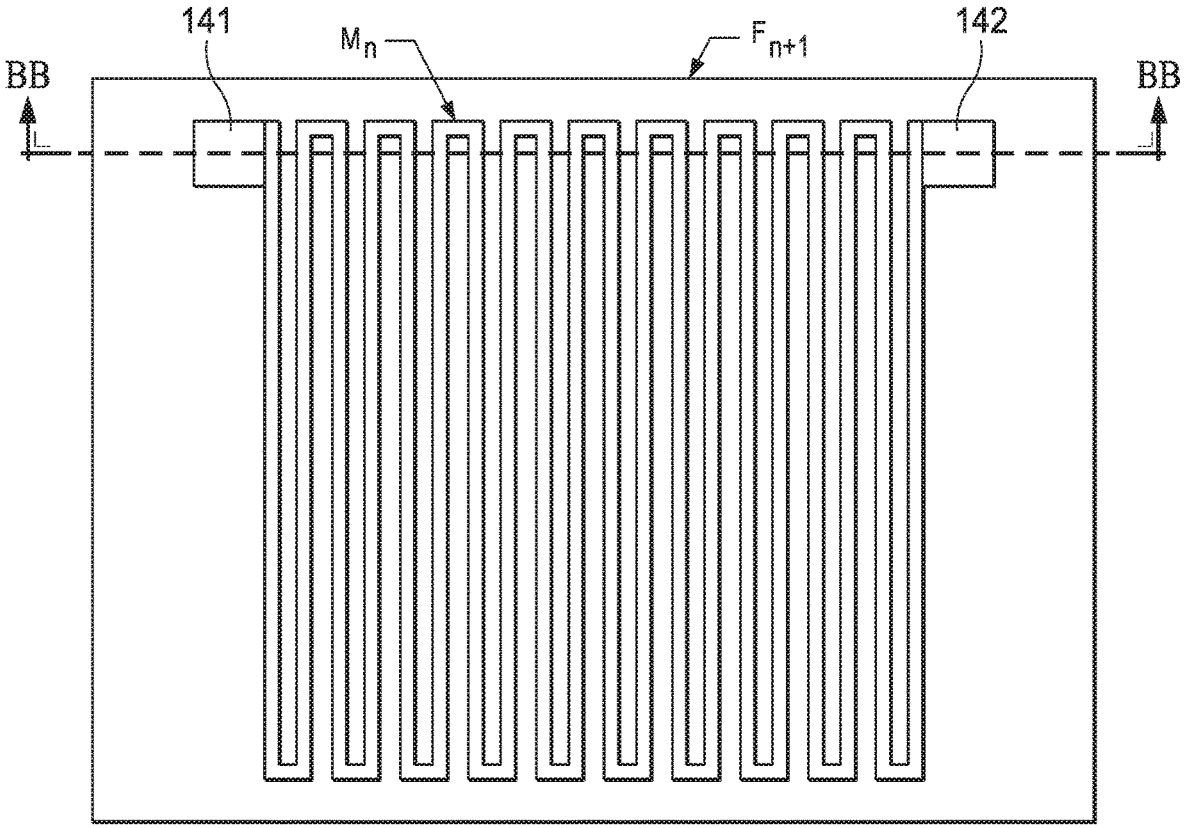
FIG. 3A illustrates a top view of a flexible layer and a metal layer of a thermistor in accordance with an embodiment of the disclosure.
Figure 3B:
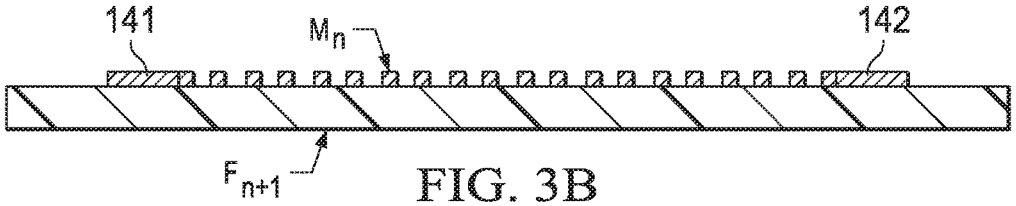
FIG. 3B illustrates a cross-sectional side view of FIG. 3A taken along line BB of FIG. 3A.

FIG. 3A illustrates a top view of metal layer $M_n$ on top of flexible layer $F_{n+1}$. FIG. 3B illustrates a cross-sectional side view of metal layer $M_n$ on top of flexible layer $F_{n+1}$ taken along line BB of FIG. 3A. In manufacturing thermistor 100, flexible layer $F_{n+1}$ is first formed on a rigid substrate. The substrate can be formed any of a number of rigid materials, such as silicon or glass. As described above, flexible layer can be formed by spin coating or CVD. Next, layer $F_{n+1}$ is exposed to light via photolithography to cure the flexible layer $F_{n+1}$.

After flexible layer $F_{n+1}$ is cured, metal layer $M_n$ can be formed on top of flexible layer $F_{n+1}$ using a resist in a "lift-off" method. In the lift-off method, a layer of resist material is applied to cover the top of flexible layer $F_{n+1}$. Next, the resist is selectively exposed to light via photolithography such that only certain areas of the resist are exposed to the light. The certain areas exposed to the light, and thus cured, are areas of flexible layer $F_{n+1}$ where metal layer $M_n$ is not desired. After the areas exposed to light are cured, the uncured areas of resist are washed away from flexible layer $F_{n+1}$. Thus, a layer of resist is left on flexible layer $F_{n+1}$ that covers areas of flexible layer $F_{n+1}$ where metal layer $M_n$ is not desired.

Next, to form metal layer $M_n$, the entire top surface of flexible surface $F_{n+1}$ and resist is coated with metal. That is, the metal is coated on top of both the resist and the areas of flexible layer $F_{n+1}$ not covered by the resist. The metal coating can be formed by processes of electron beam evaporation or sputtering. In other embodiments, each metal coating can be formed by processes of CVD deposition, atomic layer deposition, or electroplating.

After the metal coating has been applied, the resist is exposed to a solvent that dissolves the resist. When the resist is dissolved, the metal covering the resist is also removed, however the metal applied directly to the flexible layer $F_{n+1}$ is retained to form the metal layer $M_n$. Thus, when the resist is removed from flexible layer $F_{n+1}$, the metal layer $M_n$ is formed as shown is FIGS. 3A and 3B having terminals 141, 142 and the serpentine shape illustrated.

Figure 4A:
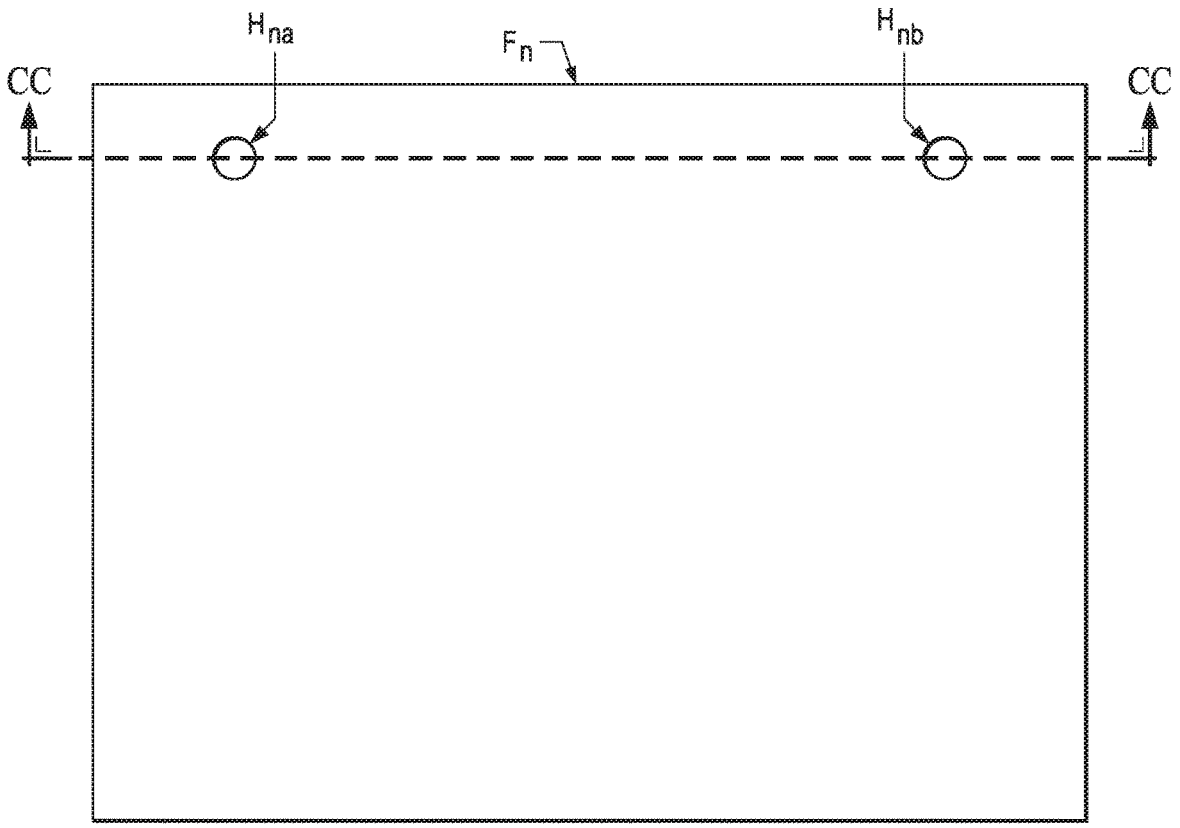
FIG. 4A illustrates a top view of two flexible layers and a metal layer of a thermistor in accordance with an embodiment of the disclosure.
Figure 4B:
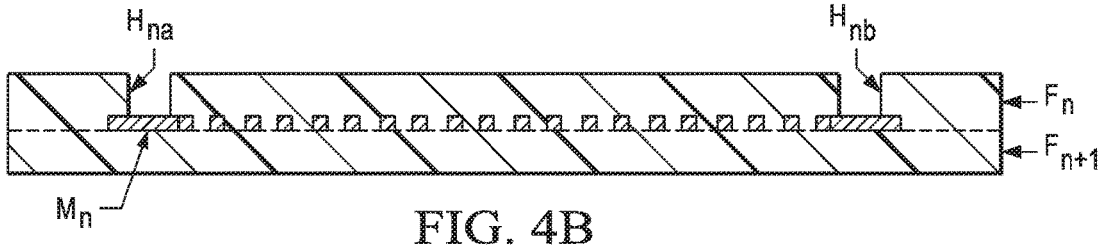
FIG. 4B illustrates a cross-sectional side view of FIG. 4A taken along line CC of FIG. 4A.

FIG. 4A illustrates a top view of flexible layer $F_n$. FIG. 4B illustrates a cross-sectional side view taken along line CC of FIG. 4A. After metal layer $M_n$ is formed, flexible layer $F_n$ is formed on top of metal layer $M_n$ and flexible layer $F_{n+1}$. As previously describe, flexible layer $F_n$ can be deposited via spin coating such that the flexible layer flows over the topography formed by metal layer $M_n$ and flexible layer $F_{n+1}$. Thus, flexible layer $F_n$ can be formed to have a flat top surface and have a bottom surface that conforms to the topography of metal layer $M_n$ and flexible layer $F_{n+1}$.

Next a curing process similar to the curing process described for flexible layer $F_{n+1}$ can be performed for flexible layer $F_n$ using photolithography. During the curing of flexible layer $F_n$, areas corresponding to the locations of via holes $H_{na}$ and $H_{nb}$ can be masked from being cured. Accordingly, all of flexible layer $F_n$ can be cured except for areas corresponding to the locations of via holes $H_{na}$ and $H_{nb}$. Thus, after curing, the part of flexible layer $F_n$ corresponding to via holes $H_{na}$ and $H_{nb}$ is washed away to form via holes $H_{na}$ and $H_{nb}$ illustrated in FIGS. 4A and 4B.

Figure 5A:
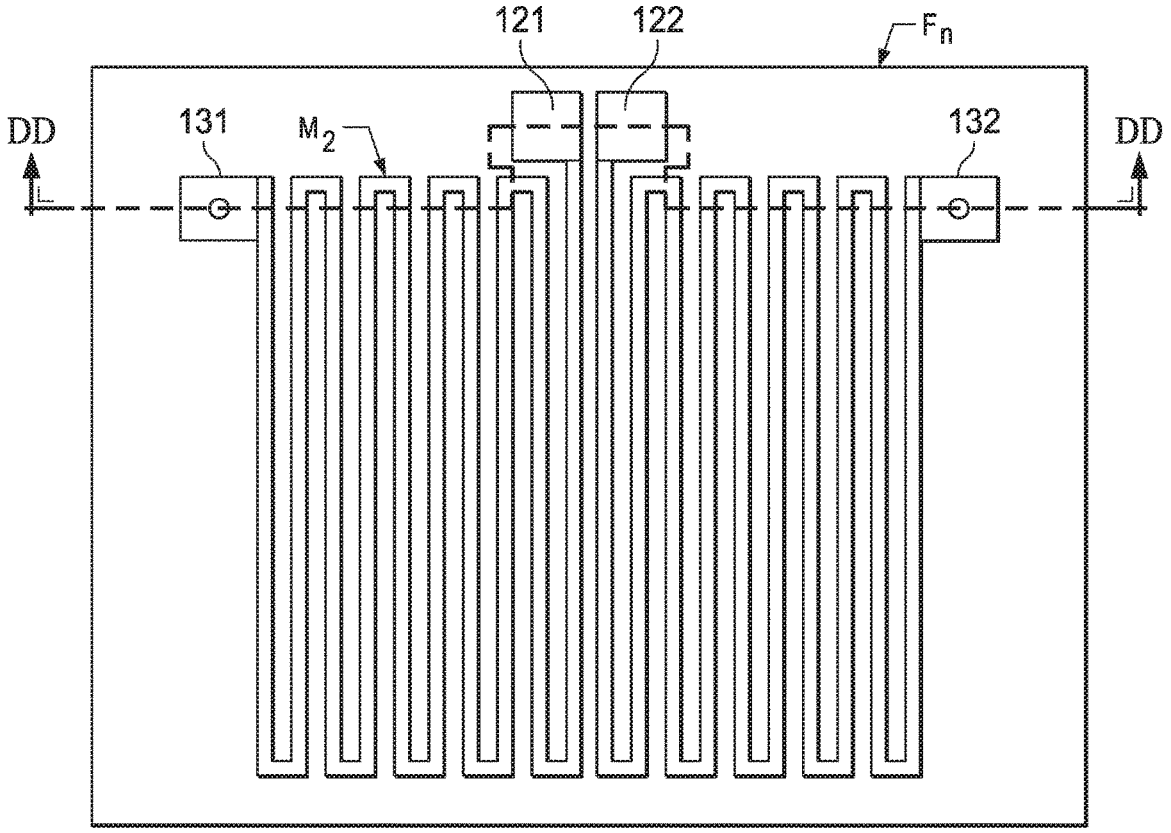
FIG. 5A illustrates a top view of two flexible layers and two metal layers of a thermistor in accordance with an embodiment of the disclosure.
Figure 5B:
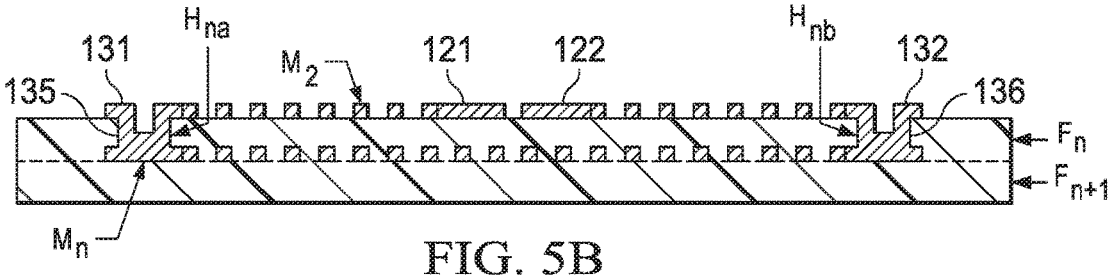
FIG. 5B illustrates a cross-sectional side view of FIG. 5A taken along line DD of FIG. 5A.
Figure 6A:
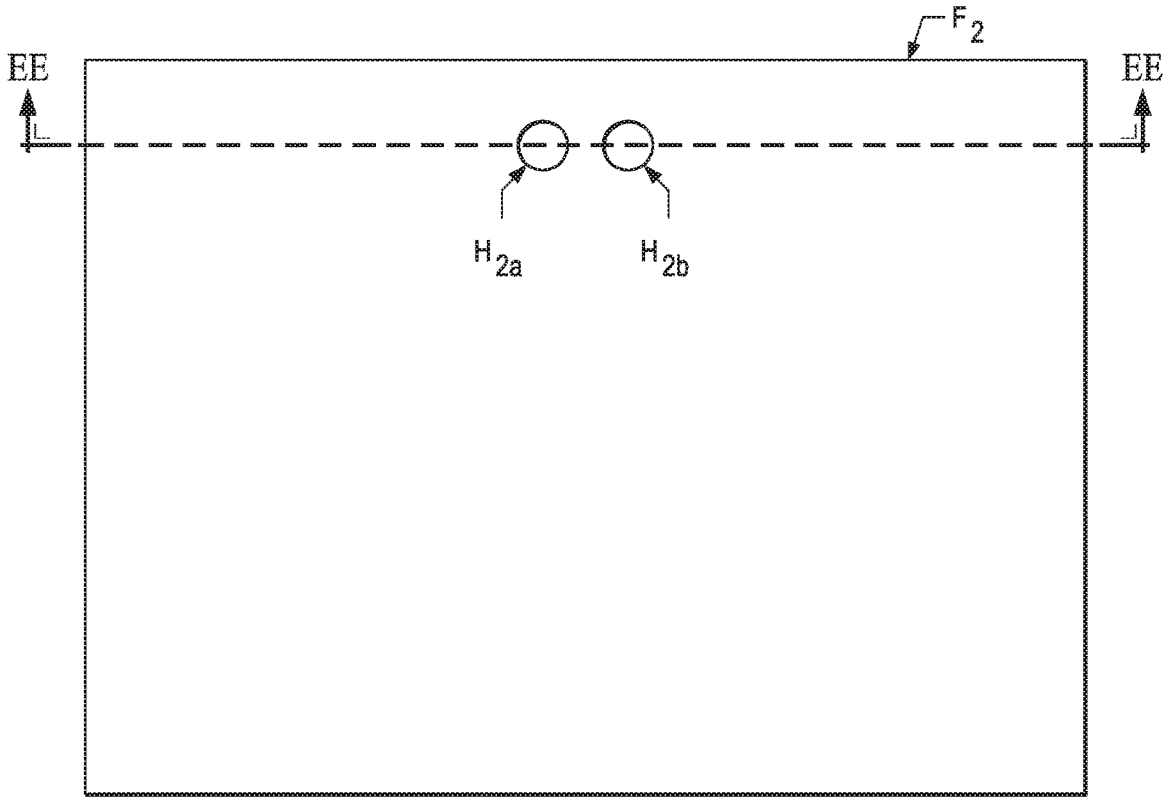
FIG. 6A illustrates a top view of three flexible layers and two metal layers of a thermistor in accordance with an embodiment of the disclosure.
Figure 6B:
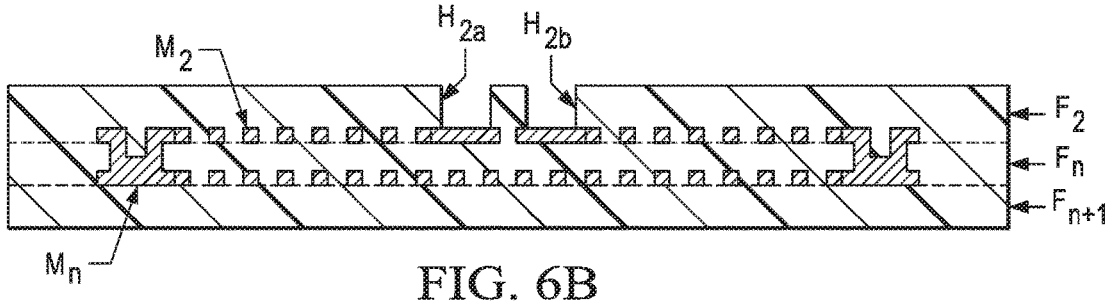
FIG. 6B illustrates a cross-sectional side view of FIG. 6A taken along line EE of FIG. 6A.

FIG. 5A illustrates a top view of meal layer $M_2$ formed on top of flexible layer $F_n$. FIG. 5B illustrates a cross-sectional side view taken along line DD of FIG. 5A. Metal layer $M_2$ is formed on flexible layer $F_n$ using the same process described above for forming metal layer $M_n$ on flexible layer $F_{n+1}$. Vias 135 and 136 are also formed during the formation of metal layer $M_2$. In forming metal layer $M_2$, resist is not cured over via holes $H_{na}$ and $H_{nb}$. Therefore, after the selected resist on top of flexible layer $F_n$ is cured, uncured resist is washed away from via holes $H_{na}$ and $H_{nb}$. When metal coating $M_2$ is applied to flexible layer $F_n$, metal forms within via holes $H_{na}$ and $H_{nb}$ so that vias 135 and 136 are formed in hole $H_{na}$ and $H_{nb}$, respectively, to contact both metal layer $M_n$ and metal layer $M_2$. Terminals 131, 121, 122, and 132 are formed during the formation of metal layer $M_2$ FIG. 6A illustrates a top view of flexible layer $F_2$. FIG. 6B illustrates a cross-sectional side view taken along line EE of FIG. 6A. Flexible layer $F_2$ is formed on top of metal layer $M_2$ and flexible layer $F_n$ using the same process for forming flexible layer $F_n$, described above. Via holes $H_{2a}$ and $H_{2b}$ are formed using the same process used to form via holes $H_{na}$ and $H_{nb}$, described above.

Figure 7A:
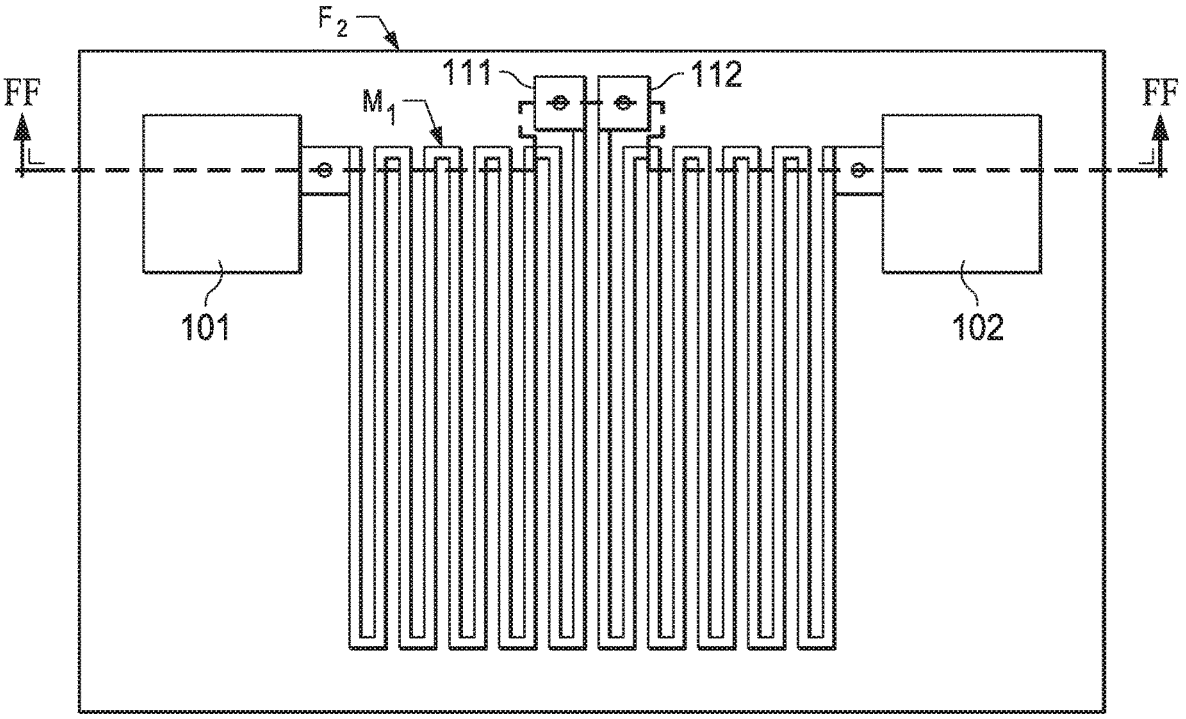
FIG. 7A illustrates a top view of three flexible layers and three metal layers of a thermistor in accordance with an embodiment of the disclosure.
Figure 7B:
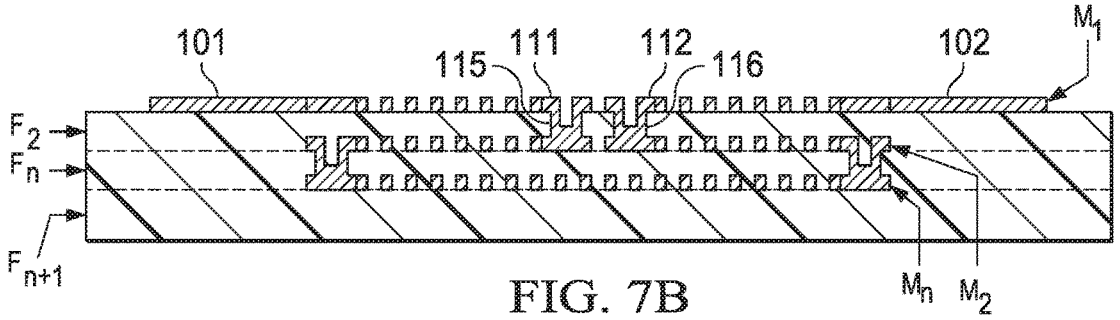
FIG. 7B illustrates a cross-sectional side view of FIG. 7A taken along line FF of FIG. 7A.

FIG. 7A illustrates metal layer $M_1$ formed on top of flexible layer $F_2$. FIG. 7B illustrates a cross-sectional side view taken along line FF of FIG. 7A. Metal layer $M_1$ is formed on top of flexible layer $F_2$ using the same process used to form metal layer $M_2$, described above. Vias 115 and 116 are formed while metal layer $M_1$ is formed using the same process used to form vias 135 and 136, described above. Terminals 101, 111, 112, and 102 are formed during the formation of metal layer $M_1$.

After metal layer $M_1$ is formed, flexible layer $F_1$ is formed on top of $M_1$, as illustrated in FIG. 1B. Holes 151 and 152 are formed using the same process used to form holes $H_{2a}$, $H_{2b}$, $H_{na}$, and $H_{nb}$, described above.

In some embodiments, a process can be used to aid in adhering each metal layer $M_n$ to the corresponding flexible layer $F_{n+1}$. In a preferred embodiment, the flexible layer $F_{n+1}$ is exposed to an oxygen-based plasma before the metal layer $M_n$ is deposited to the flexible layer $F_{n+1}$. In another embodiment, the metal layer $M_n$ and corresponding flexible material layer $F_{n+1}$ can be exposed to argon ions before depositing flexible layer $F_n$ to the metal layer $M_n$ and flexible layer Fri-pi. Exposing the metal layer $M_n$ and the flexible layer $F_{n+1}$ to argon ions can "roughen" the mating surfaces of the metal layer $M_n$ and the flexible layer $F_{n+1}$ to increase surface are and allow for better adhesion between the flexible layer $F_n$ and metal layer $M_n$ and the flexible layer $F_{n+1}$. The metal layer $M_n$ and the flexible layer $F_{n+1}$ can be exposed to argon ions through an ion mill or an argon plasma process.

In some embodiments, a process can be used to aid in adhering adjacent flexible material layers. In a preferred embodiment, before adhering flexible material layer $F_n$ to layer $F_{n+1}$, the flexible material layers $F_n$ and $F_{n+1}$ are exposed to an oxygen plasma.

Figure 8:
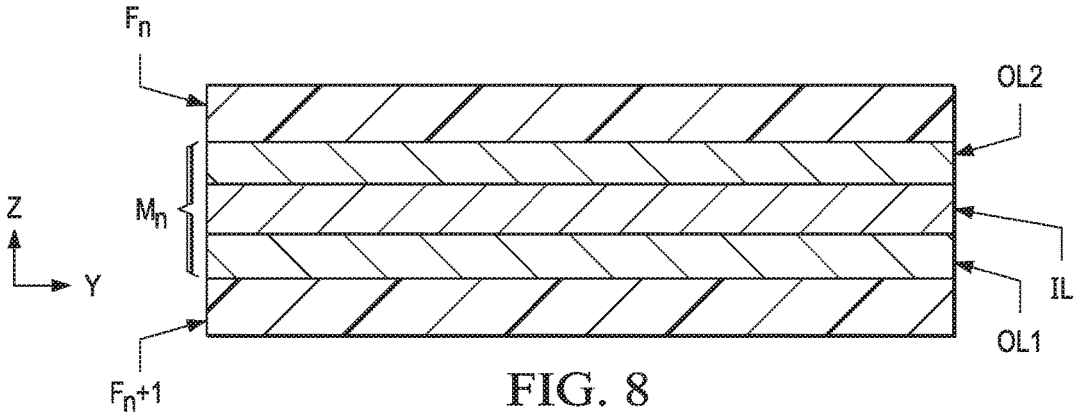
FIG. 8 illustrates a cross-sectional view of a meal foil layer and two flexible material layers of a thermistor in accordance with an embodiment of the disclosure.

FIG. 8 is a partial cross-section view of a meal foil layer and two flexible material layers of a thermistor in accordance with an embodiment of the disclosure. FIG. 8 is taken through the conductive trace of the metal foil layer $M_n$ and flexible layers $F_n$ and $F_{n+1}$. In an embodiment, the trace or foil of the metal foil layer $M_n$ can be comprised of a laminate of different metals or different metal alloys. The trace or foil of the metal foil layer $M_n$ can comprise outer layers OL disposed to contact the flexible mater layers $F_n$ and $F_{n+1}$. In a preferred embodiment, the outer layers OL are made of platinum and the inner layer IL is made of gold. In other embodiments, chrome can be used as the OL.

Platinum has a number of properties that make it a desirable metal for the OL in a foil laminate. Preferably, the traces or foils of the metal layer $M_n$ will adhere to the polymer flexible material layers or else the metal layer can peel off from the flexible material under certain temperatures or during manufacturing. Platinum has desirable adhesion properties to polymers. Thus, using platinum as an OL is desirable to keep the laminate metal layer $M_n$ from peeling from the flexible material layers $F_n$, $F_{n+1}$.

Gold can be used as the IL in a laminate foil to further help in preventing the metal layer $M_n$ from peeling from the flexible layers and/or deformation of the flexible material. Metal films have an inherent stress to them when they are deposited. The inherent stress can be characterized as either compressive stress of tensile stress. Platinum has a tensile stress when deposited, while gold has a compressive stress. The tensile deformation of the platinum can cause the flexible material layer $F_{n+1}$ to deform or can cause the metal layer $M_n$ to peel from the flexible material layer $F_{n+1}$. In a preferred embodiment, a gold IL is deposited between the platinum OL's. Since gold has compressive stress properties when deposited, the gold helps to "cancel out" the tensile stress properties of the platinum OL's to prevent the flexible layers from being deformed and to keep the metal layer $M_n$ from peeling from the flexible layers. However, one skilled in the art will recognize that having gold layered in between platinum is not required. In another embodiment the foil layer $M_n$ can be completely of platinum.

In a preferred embodiment, a thickness measured in the Z-direction (i.e., the stacking direction) of the OL of platinum in contact with the flexible layer $F_{n+1}$ is 500 Angstroms. In a preferred embodiment, a thickness measured in the Z-direction of the gold IL is 2,000 Angstroms. In a preferred embodiment, a thickness measured in the Z-direction of the OL of platinum in contact with the flexible layer $F_n$ is 1,500 Angstroms.

One skilled on the art will recognize that that metals with desirable properties similar to platinum and gold can be used as the OL and IL, respectively. Additionally, one skilled in the art will recognize that the number of the layers and thickness of the layers of the metal coil layer $M_n$ can be altered and still be in accordance with the disclosure.

Although the present disclosure has been described with various embodiments, various changes and modifications may be suggested to one skilled in the art. It is intended that the present disclosure encompass such changes and modifications as falling within the scope of the appended claims.

What is claimed is:

1. A three-dimensional thermistor device comprising:

a thermistor array formed on a base layer extending in first and second directions;

wherein the thermistor array comprises:

thermistor pattern layers and insulating layers stacked alternately on the base layer in a third direction;

each thermistor pattern layer including a continuous electrically conductive first trace disposed along a first path extending in both the first and second directions, each first trace having a respective first terminal point and a respective second terminal point spaced-apart along the first path and an effective length measured along the first path between the first and second terminal points; and each insulating layer including an electrically conductive first via extending through the insulating layer in the third direction;

wherein the respective first terminal point of each thermistor pattern layer is electrically connected to the respective first via of one adjacent-stacked insulating layer and the respective second terminal point of that thermistor pattern layer is electrically connected to the respective first via of the other adjacent-stacked insulating layer, and wherein successive electrical connections between the respective first vias on the stacked insulating layers and the respective first traces on the stacked thermistor layers form a continuous electrical first thermistor element extending in the first, second and third directions across multiple of the thermistor pattern layers and having a first thermistor element length, the first thermistor element length being greater than or equal to a sum of the respective effective lengths of the respective first traces on the thermistor pattern layers.

2. The three-dimensional thermistor device of claim 1, wherein the first traces are formed of a metal or metal alloy.

3. The three-dimensional thermistor device of claim 2, wherein the first traces are foils of metal or metal alloy.

4. The three-dimensional thermistor device of claim 3, wherein the metal foils are laminates formed of two different metals or metal alloys.

5. The three-dimensional thermistor device of claim 1, wherein the insulating layer is formed of a flexible polyimide material.

6. The three-dimensional thermistor device of claim 1, further comprising:

each thermistor pattern layer including a continuous electrically conductive second trace disposed along a second path extending in both the first and second directions, each second trace having a respective third terminal point and a respective fourth terminal point spaced-apart along the second path and an effective length measured along the second path between the third and fourth terminal points;

each insulating layer including an electrically conductive second via extending through the insulating layer in the third direction;

wherein the respective third terminal point of each thermistor pattern layer is electrically connected to the respective second via of one adjacent-stacked insulating layer and the respective fourth terminal point of that thermistor pattern layer is electrically connected to the respective second via of the other adjacent-stacked insulating layer, and wherein successive electrical connections between the respective second vias on the stacked insulating layers and the respective second traces on the stacked thermistor layers form a continuous electrical second thermistor element extending in the first, second and third directions across multiple of the thermistor pattern layers and having a second thermistor element length, the second thermistor element length being greater than or equal to a sum of the respective effective lengths of the respective second traces on the thermistor pattern layers; and the base layer including a continuous electrically conductive third trace disposed along a third path extending in both the first and second directions, the third trace having a fifth terminal point and a sixth terminal point spaced-apart along the third path; and wherein the fifth terminal point of the base layer is electrically connected to the first thermistor element and the sixth terminal point of the base layer is electrically connected to the second thermistor element to form a combined thermistor element extending in the first, second and third directions across multiple of the thermistor pattern layers, the combined thermistor element having an overall thermistor length greater than or equal to a sum of the first thermistor element length and the second thermistor element length.

7. The three-dimensional thermistor device of claim 6, wherein each electrical end of the combined thermistor element is connected to a device terminal, and the device terminals are accessible from a single side of the thermistor device.

8. The three-dimensional thermistor device of claim 6, wherein the first traces and second traces have a serpentine-type structure along the first and second directions.

9. A three-dimensional thermistor device electrically connectable with an electrical circuit, the three-dimensional thermistor device comprising:

a plurality of terminals including a first terminal and a second terminal, the first and second terminals configured to electrically connect the three-dimensional thermistor device to the electrical circuit;

a plurality of traces, the plurality of traces disposed along a stacking axis, the plurality of traces comprising:

a first trace disposed at a first end of the three-dimensional thermistor device along the stacking axis, a last trace disposed at a second end of the three-dimensional thermistor device opposite of the first end along the stacking axis, and at least one intermediate trace disposed along the stacking axis between the first trace and last trace, wherein each of the plurality of traces comprises at least one via configured to electrically connect the respective trace to an adjacent trace of the plurality of traces; and a plurality of flexible insulating layers disposed along the stacking axis, the plurality of flexible insulating layers comprising:

a first flexible insulating layer disposed along the stacking axis adjacent to an outside surface of the first trace, a last flexible insulating layer disposed along the stacking axis adjacent to an outside surface of the last trace, and at least one intermediate flexible insulating layer disposed along the stacking axis between the first flexible insulating layer and the last flexible insulating layer, wherein the plurality of traces are interleaved with the plurality of flexible insulating layers along the stacking axis such that each of the plurality of traces is disposed between and adjacent to two of the plurality of flexible insulating layers.

10. The three-dimensional thermistor device of claim 9, wherein each of the plurality of traces is formed of a metal or metal alloy.

11. The three-dimensional thermistor device of claim 10, wherein each of the plurality of traces is a laminate formed of two different metals or metal alloys.

12. The three-dimensional thermistor device of claim 11, wherein the laminate comprises:

a first layer of platinum;

a layer of gold overlying the first layer of platinum; and a second layer of platinum overlying the layer of gold.

13. The three-dimensional thermistor device of claim 9, wherein each of the plurality of flexible insulating layers is formed of a flexible polyimide material.

14. The three-dimensional thermistor device of claim 9, wherein:

each of the first trace and the at least one intermediate trace comprise a first trace portion and a second trace portion, the at least one via of each of the plurality of traces includes a first via and a second via, each of the plurality of the first trace portions is electrically connected to an adjacent first trace portion by the first via of the respective trace such that each of first trace portions are electrically connected to each other to form a first electrically connected portion, each of the plurality of the second trace portions is electrically connected to an adjacent second trace portion by the second via of the respective trace such that the plurality of second trace portions are electrically connected to each other to form a second electrically connected portion, and the first via of the last trace contacts the first electrically connected portion and the second via of the last traces contacts the second electrically connection portion such that the last trace electrically connects the first electrically connected portion to the second electrically connected portion to form a combined electrically connected portion, the combined electrically connected portion having an overall length greater than or equal to a sum of a length of the first electrically connected portion and a length of the second electrically connected portion.

15. The three-dimensional thermistor device of claim 14, wherein:

the first trace portion of the first trace includes the first terminal, the second trace portion of the first trace includes the second terminal, the first terminal and second terminal are disposed on a single side of the three-dimensional thermistor device.

16. The three-dimensional thermistor of claim 9, wherein each of the plurality of traces has a serpentine-type structure along a plane perpendicular to the stacking axis.

17. A method for manufacturing a three-dimensional thermistor device, the method comprising:

forming a first flexible insulating layer;

depositing a first trace layer on a top surface of the first flexible insulating layer;

depositing a second flexible insulating layer on a top surface of the first trace layer, the second flexible insulating layer comprising at least one through-hole through which the first trace layer is exposed;

depositing a second trace layer on a top surface of the second flexible insulating layer, the second trace layer including at least one via formed in the at least one through-hole of the second flexible insulating layer that contacts the first trace layer to electrically connect the first trace layer and the second trace layer; and depositing a third flexible insulating layer on a top surface of the second trace layer, the third flexible insulating layer comprising a through-hole through which the second trace layer is exposed; and wherein:

the second trace layer comprises a first trace portion and a second trace portion, the at least one through-hole of the second flexible insulating layer comprises a first through-hole and a second through-hole, the at least one via comprises a first via formed in the first through-hole and electrically connected to the first trace portion and a second via formed in the second through-hole and electrically connected to the second trace portion, and the first trace layer is electrically connected to the first via and the second via.

18. The method of claim 17, wherein the depositing of at least one of the first trace layer and the second trace layer comprises depositing the trace layer as a laminate formed of two different metals or metal alloys.

19. The method of claim 17, wherein:

the first trace layer is deposited on the top of the first flexible insulating layer to have a serpentine-type structure, and the second trace layer is deposited on the top of the second flexible insulating layer to have a serpentine-type structure.

* * * * *